US006363639B1

(12) United States Patent
Chan

(10) Patent No.: US 6,363,639 B1
(45) Date of Patent: Apr. 2, 2002

(54) PICTURE DISPLAY UNIT

(75) Inventor: Sik-Leung Chan, Tsuen Wan (HK)

(73) Assignee: C. C. & L Company Limited, Tsuen Wan (CN)

( * ) Notice: Subject to any disclaimer, the term of this patent is extended or adjusted under 35 U.S.C. 154(b) by 0 days.

(21) Appl. No.: 09/609,859

(22) Filed: Jul. 5, 2000

(51) Int. Cl.[7] ..... G09F 11/30
(52) U.S. Cl. ..... 40/509; 40/721
(58) Field of Search ..... 40/509, 721, 476, 40/508, 511, 762, 513, 526, 530, 735, 734, 753, 500, 537, 533, 722; D6/300, 301, 316, 310, 632

(56) References Cited

U.S. PATENT DOCUMENTS 4,033,058 A * 7/1977 Lyman
4,546,561 A * 10/1985 Ackeret ..... 40/513
5,163,240 A * 11/1992 Byers ..... 40/533

* cited by examiner

*Primary Examiner*—Douglas C. Butler
(74) *Attorney, Agent, or Firm*—Alix, Yale & Ristas, LLP

(57) ABSTRACT

A box-like picture display unit is arranged to display two framed pictures in windows (12 and 13). The pictures are moved in turn from a stack (15) by movement of a carriage (14) up and down. When the carriage (14) is moved upwards, a finger (18) engages a recess (20) in a back of a rear picture in the stack and lifts and carries the picture to the window (12). When the carriage moves downwards, a fixed arm (21) pushes the picture down from the window (12) to opposite the window (13), and in front of the stack (15). The carriage is moved down by manually pressing on a top part (25) of the carriage. The carriage is moved upwards automatically under the action of a pair of coiled springs (26), the springs being charged; i.e., wound up, during and by downward movement of the carriage (14).

7 Claims, 5 Drawing Sheets

PICTURE DISPLAY UNIT

BACKGROUND OF THE INVENTION

1. Field of the Invention

The invention relates to picture display units.

2. Description of Prior Art

The invention relates more particularly, although not exclusively, to display units for photographs, slides and the like. The pictures (or slides) are separately mounted.

SUMMARY OF THE INVENTION

It is an object of the invention to enable a number of pictures to be displayed in turn in a convenient manner using a simply constructed multi-picture container unit.

According to the invention, there is provided a manually operable box-like picture display unit, said unit having a housing including a front wall for supporting a vertical stack of forward-facing mounted pictures inside the unit, a window in the front wall, a slidable carriage mounted in the unit to enable the pictures to be displayed in turn, the carriage being arranged to move in a first direction a rear picture of the stack, when the carriage moves in the same direction, beyond the stack and transport the picture forwards for viewing through the window, and the carriage being arranged, when the carriage moves in the opposite second direction, to push the picture in the same direction from behind the window into a front of the stack.

Preferably, the front wall has a second window adjacent the said window, the second window being positioned in the front wall in front of the stack.

In a preferred embodiment, the picture display unit includes a carriage biassing means to bias the carriage towards a first position in said first direction and to move the carriage to the first position whenever manually pressure in said second direction is removed from the carriage.

More preferably, the picture display unit includes damping means arranged to reduce the speed at which the carriage moves in side first direction under the influence of the biassing means.

It is preferred that each picture has a rear-facing recess and the carriage has a pivotable finger arranged to ride into the recess and be urged into the recess to move the picture in said first direction when the carriage moves in the same direction.

The picture display unit may include a rack and pinion mechanically connected between the carriage and the unit for moving the carriage in said first direction.

In a preferred embodiment, the housing includes a base for receiving the stack of pictures and the carriage is slidable upwards in said first direction and downwards in said second direction.

BRIEF DESCRIPTION OF THE DRAWINGS

A manually operable box-like picture display unit according to the invention will now be described by way of example with reference to the accompanying drawings in which.

DETAILED DESCRIPTION OF PREFERRED EMBODIMENT

Figure 1:
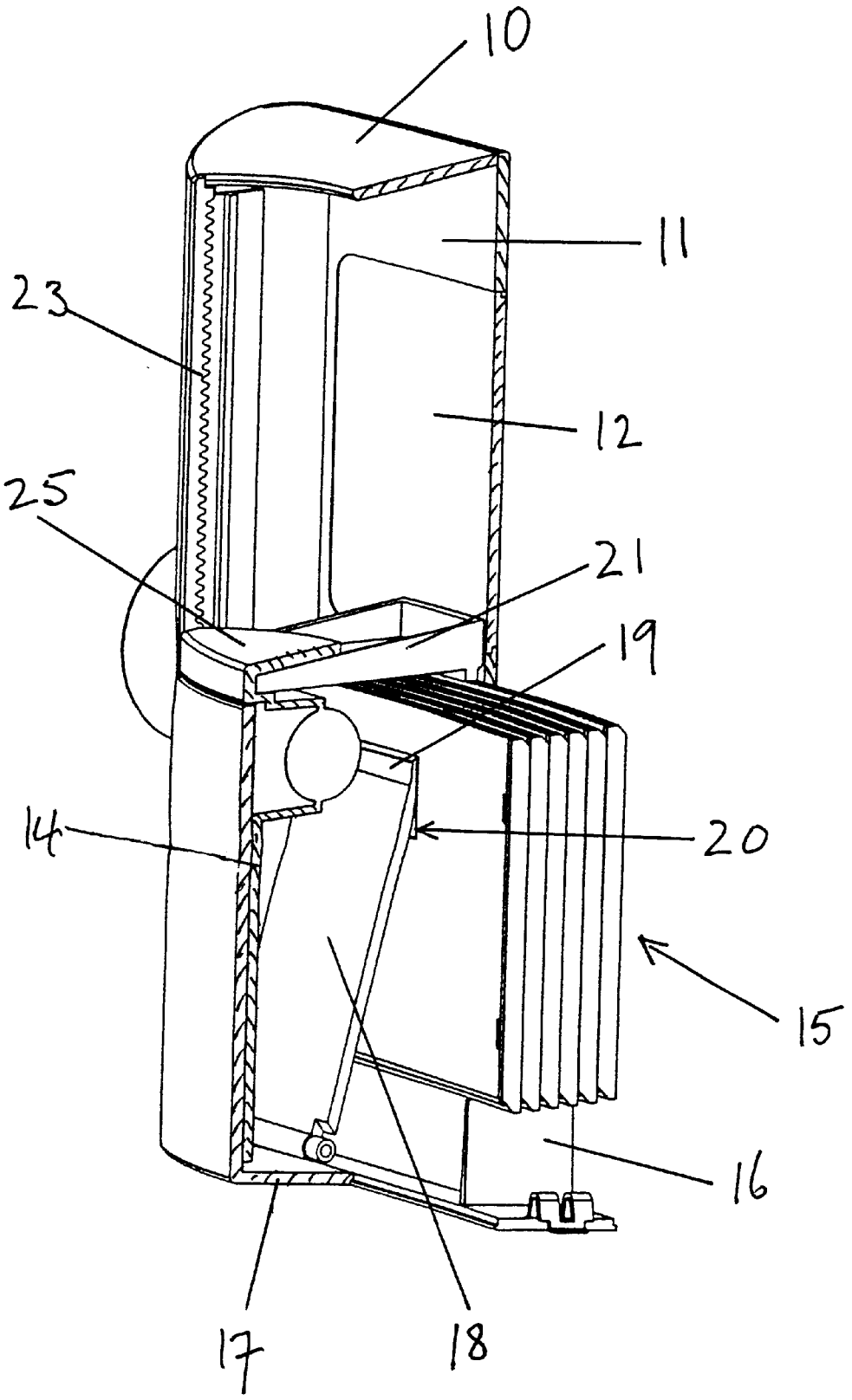
FIG. 1 shows a sectional rear side view of the unit; with a carriage in a lowermost position.

Referring to the drawings, the unit has a box-like housing 10 with a vertical planar front wall 11 in which there is an upper and lower window 12 and 13. A vertically slidable carriage 14 is supported in the housing 10. A vertical stack of (six) separately mounted pictures 15 (the drawing shows picture frames without pictures) is supported by a horizontally slidable pedestal 16 above a base 17 of the housing.

Figure 2:
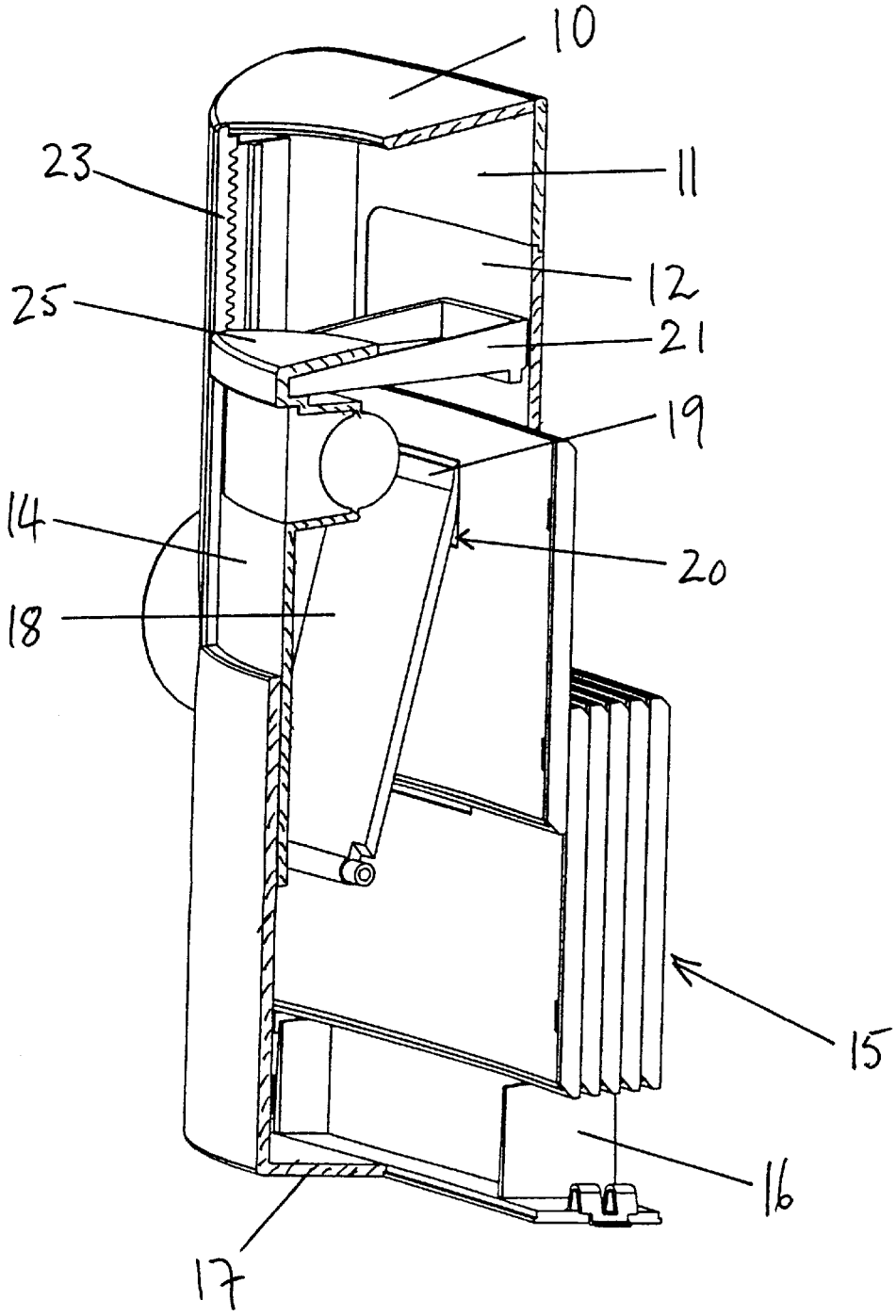
FIG. 2 shows a sectional rear side view of the unit with the carriage in an intermediate vertical position as the carriage moves upwards.
Figure 3:
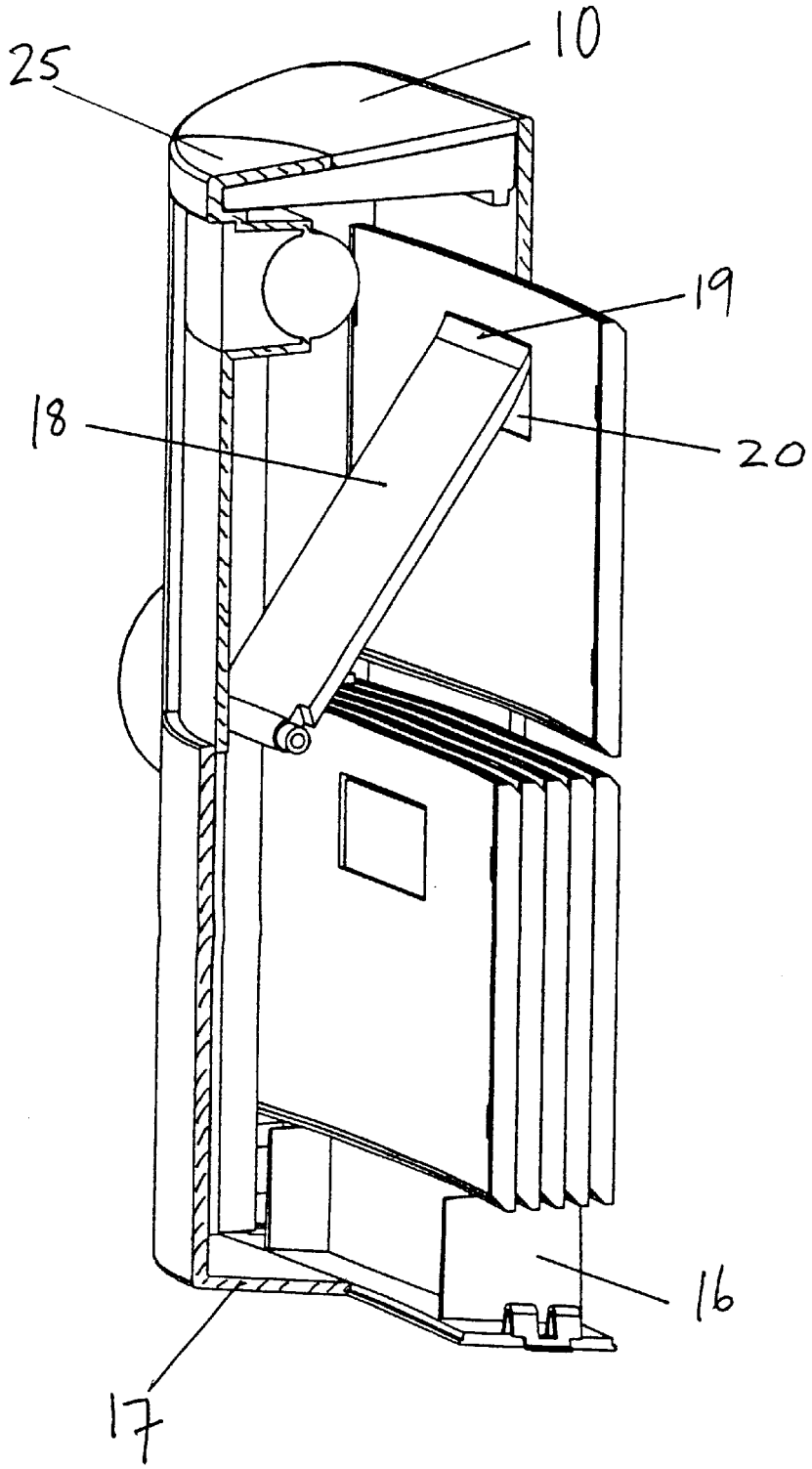
FIG. 3 shows a sectional rear side view of the unit with the carriage in an uppermost position.

The carriage 14 has a loosely pivoted finger 18 with a tapered end 19 that can fit into recesses 20 formed in a rear face of each of the mounted pictures. When the carriage 14 moves upwards the finger 20 is inherently urged into a recess 20 of a rear picture of the stack, by its shape and by gravity, so as to lift the picture up (see FIG. 2). The finger 20 also presses or transports the picture forwards so that as soon as the rear picture has risen above the rest of the pictures in the stack, the picture moves forwards to a position for viewing through the window 12 (see FIG. 3).

Figure 4:
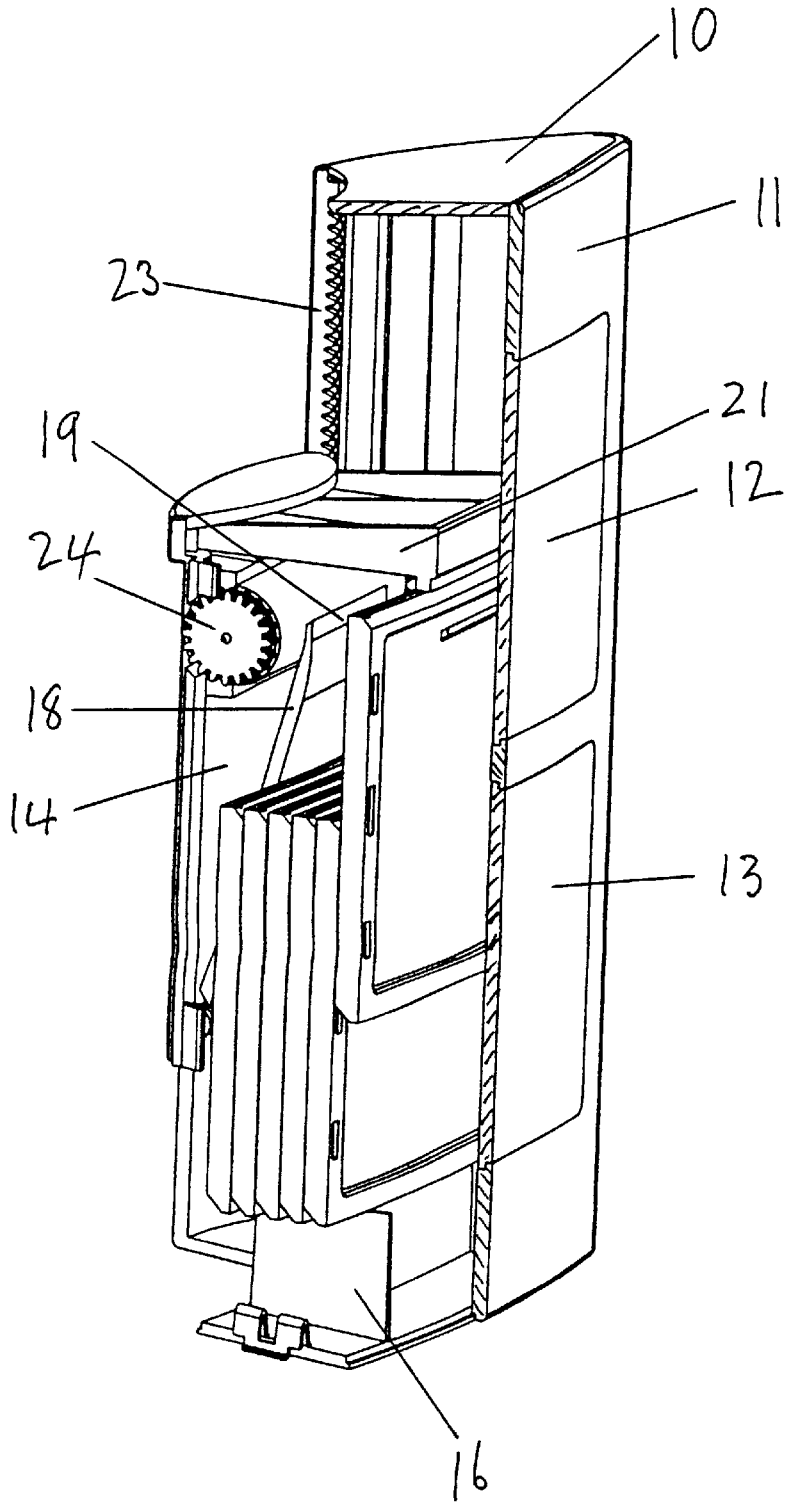
FIG. 4 shows a sectional front side view of the unit with the carriage in an intermediate vertical position as the carriage moves downwards.
Figure 5:
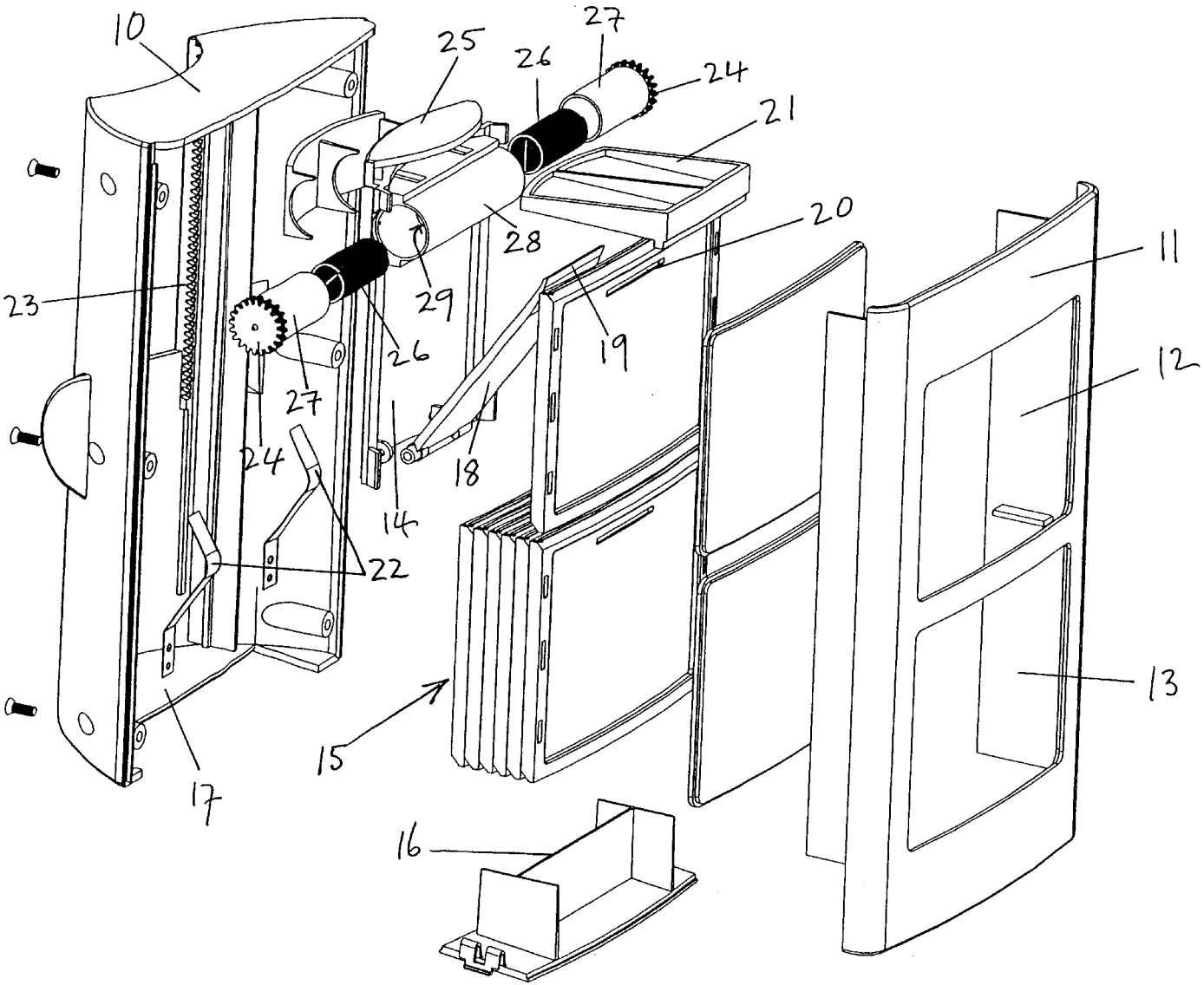
FIG. 5 is an exploded front side view of the unit.

When the carriage 14 moves downwards, a fixed arm 21 connected to the carriage pushes the picture downwards, away from the window 12, and into a front of the stack of pictures (see FIG. 4). During that time the finger 18 purchases against the top of the stack so that its end 19 is lifted out of the recess 20 and allows the finger to move down behind the stack as required for the next cycle of operation.

Thus, movement of the carriage serves to feed, as it were, pictures from the rear of the stack into view through the window 12 and then into place in front of the stack when the carriage moves down towards its lowermost position. In this way each picture can be shown, or be visible, in sequence through the window 12.

It will be noted that in order to ensure that the pictures feed easily and in an orderly manner, the picture frames, as shown in the drawings, have bevelled upper and lower edges that guide each picture frame, as it is pushed by the carriage downwards from the window 12, to take up its position at the front position of the stack, as required. At the same time, lower edges of pictures in the stack are able to slide easily across the pedestal 16, the stack being held in a vertical array by a pair of resilient guides 22.

It will be noted that the window 13 is positioned in the wall 11 so that this window allows a current picture at the front of the rack to remain totally visible, except during a period when a picture is being pushed down from the window 12. Thus, for most of the time two pictures are permanently visible from outside the unit.

A mechanism is provided for automatically raising the carriage 14 and comprises a pair of racks 23 and respectively co-operating pinions 24. In use, the carriage 14 is pressed down manually by pushing down on a top part 25 of the carriage. As the carriage moves down, the pinions 24 are rotated by the racks 23 to wind up a pair of coil springs 26. Adjacent a lowermost position of the carriage, as the carriage moves upwards, the finger 18 engages an appropriate recess 20, as explained earlier. The carriage is moved upwards automatically, as soon as manual downward pressure on the part 25 is removed, using stored energy (i.e. spring bias force) of the springs 26. This energy is sufficient to cause the rear picture to be lifted up and then carried directly to behind the window 12.

Preferably, the pinions 24 are supported and rotatable with cylindrical sleeves 27 (that embrace the springs 26) and which fit into a stationary central support housing 28. A small brake pad 29 is provided inside the housing 28 to "dampen", that is to slow down, the speed of rotation of the pinions 24. This ensures that, under the bias of the springs 26, the carriage 14 does not move upwardly too quickly. It will be appreciated that other forms of speed damping may be used, if preferred, such as a small air fan or hydraulic ram.

It is envisaged that the subject picture display unit may be designed for use with the housing 10 (suitably modified) lying on one side, in which case the two windows 12 and 13 become side-by-side and the carriage 14 is horizontally slidable.

The invention has been given by way of example only, and various modifications of and/or alterations to the described embodiment may be made by persons skilled in the art without departing from the scope of the invention as specified in the appended claims.

What is claimed is:

1. A manually operable box-like picture display unit, said unit having a housing including a front wall for supporting a vertical stack of forward-facing mounted pictures inside the unit, a window in the front wall, a slidable carriage mounted in the unit to enable the pictures to be displayed in turn, the carriage being arranged to move in a first direction a rear picture of the stack, when the carriage moves in the same direction, beyond the stack and transport the picture forwards for viewing through the window, and the carriage being arranged, when the carriage moves in the opposite second direction, to push the picture in the same direction from behind the window into a front of the stack.

2. A manually operable box-like picture display unit according to claim 1, wherein the window is a first window and in which the front wall has a second window adjacent the said first window, the second window being positioned in the front wall in front of the stack.

3. A manually operable box-like picture display unit according to claim 1, including a carriage biassing means to bias the carriage towards a first position in said first direction and to move the carriage to the first position whenever manually pressure in said second direction is removed from the carriage.

4. A manually operable box-like picture display unit according to claim 3, including damping means arranged to reduce the speed at which the carriage moves in side first direction under the influence of the biassing means.

5. A manually operable box-like picture display unit according to claim 1, in which each picture has a rear-facing recess and the carriage has a pivotable finger arranged to ride into the recess and be urged into the recess to move the picture in said first direction when the carriage moves in the same direction.

6. A manually operable box-like picture display unit according to claim 1, including a rack and pinion mechanically connected between the carriage and the unit for moving the carriage in said first direction.

7. A manually operable box-like picture display unit according to claim 1, wherein the housing includes a base for receiving the stack of pictures and the carriage is slidable upwards in said first direction and downwards in said second direction.

* * * * *